US006009936A

United States Patent [19]

Kubota et al.

[11] Patent Number: 6,009,936

[45] Date of Patent: Jan. 4, 2000

[54] HEAT EXCHANGER

[75] Inventors: Junichi Kubota, Ota; Junichi Motegi, Kumagaya; Setsuo Matsumoto, Chiyoda-machi; Hideaki Kuribara, Nitta-machi; Kazuaki Mabuchi, Koga, all of Japan

[73] Assignees: Sanyo Electric Co., Ltd., Moriguchi; Sanoh Kogyo Kabushiki Kaisha, Koga, both of Japan

[21] Appl. No.: 09/060,615

[22] Filed: Apr. 15, 1998

[30] Foreign Application Priority Data

| | | | |
|---|---|---|---|
| Apr. 17, 1997 | [JP] | Japan | 9-100475 |
| Oct. 15, 1997 | [JP] | Japan | 9-281687 |
| Oct. 15, 1997 | [JP] | Japan | 9-281689 |

[51] Int. Cl.[7] ..... F28F 1/14

[52] U.S. Cl. ..... 165/183; 165/182; 165/181; 29/890.046

[58] Field of Search ..... 165/183, 181, 165/151, 150, 182, 104.33; 29/890.038, 890.046

[56] References Cited

U.S. PATENT DOCUMENTS

| | | | |
|---|---|---|---|
| 440,671 | 11/1890 | Weisel | 165/181 |
| 2,347,957 | 5/1944 | McCullough | 165/181 |
| 2,574,142 | 11/1951 | Buongirno | 165/181 |
| 2,656,808 | 10/1953 | Plumeri et al. | 165/181 |
| 2,737,370 | 3/1956 | Frisch et al. | 165/181 |
| 3,153,443 | 10/1964 | Kritzer | 165/181 |
| 3,221,399 | 12/1965 | Karmazin | 165/181 |
| 4,236,578 | 12/1980 | Kreith et al. | 165/181 |
| 5,046,556 | 9/1991 | Andersson | 165/181 |
| 5,240,070 | 8/1993 | Ryan | 165/181 X |
| 5,309,982 | 5/1994 | Aliano | 165/181 X |

FOREIGN PATENT DOCUMENTS

| | | | |
|---|---|---|---|
| 1261990 | 4/1961 | France | 165/181 |
| 2034409 | 12/1970 | France | 165/181 |
| 2642572 | 3/1978 | Germany | 165/181 |
| 492164 | 3/1954 | Italy | 165/181 |
| 0042154 | 3/1982 | Japan | 165/104.33 |
| 0084990 | 5/1982 | Japan | 165/104.33 |
| 0958837 | 9/1987 | U.S.S.R. | 165/181 |

*Primary Examiner*—Christopher Atkinson
*Attorney, Agent, or Firm*—Ladas & Parry

[57] ABSTRACT

A heat exchanger comprises a tube 11 and fin plates 12 attached to the outer surface of the tube. Each fin plate 12 is in the form of a strip sheet which is wider than the diameter of the tube 11, and each fin plate 12 is fitted on the tube 11 and has a semicylindrical recess 20 in the form corresponding to the cylindrical shape of the tube 11. Flat fins 21 extend from both sides of the semicylindrical recess 20. Cut pieces 22*a* are formed each by a U-shaped cut 22 at a predetermined pitch in the longitudinal direction of the semicylindrical recess 20, and each cut piece is erected outwardly of the semicylindrical recess to thereby form an upstanding fin 23, which is formed on a first fin plate element 18 as well as a second fin plate element 19. Straight tube portion 15 of the tube 11 is fitted between the semicylindrical recesses 20 of the first fin plate element 18 and the second fin plate element 19. In this way, the tube and the fin plate 12 are secured. This provides a heat exchanger for a refrigerator which has an increased radiating area and which is compact in size.

24 Claims, 12 Drawing Sheets

HEAT EXCHANGER

BACKGROUND OF THE INVENTION

1. Field of the Invention

The present invention relates to a heat exchanger, and more particularly to a finned heat exchanger.

2. Description of the Background Art

As conventional finned heat exchangers, a spiral finned heat exchanger, a corrugated finned heat exchanger and so on are known.

The spirally finned heat exchanger is produced in such a way that a fin made of aluminum or iron material is wound spirally by means of a fin wrapping machine around the circumferential surface of parallel straight tube portions of a serpentine or zigzag tube made of copper or iron material with a predetermined pitch so that the outer peripheral edge of the fin assumes a cylindrical shape, and, thereafter, the wound fin is brazed to the circumferential surface of the tube. The corrugated finned heat exchanger is produced in such a way that a corrugated fin made of aluminum is secured to parallel straight tube portions of a serpentine or zigzag tube by fitting cutouts formed in the corrugated fins in the direction of the height of the corrugation onto the straight tube portions.

There are the following problems in the above-described heat exchangers. The spirally finned heat exchanger described above is not simple in terms of the operation of winding the fin and is inferior in quantity production. Furthermore, the fin winding machine has a restriction in that the outer diameter of the fin cannot be made small and the pitch of the fin cannot be made fine. Similarly, the corrugated finned heat exchanger is not simple in terms of operation and inferior in quantity production. Further, the pitch of the fin cannot be made fine from a viewpoint of the operation of fitting the fin onto the tube. Accordingly, there are problems in that these known heat exchangers are poor in quantity production and large in size, and have a small radiating surface of the fins in relation to the large size of the exchanger itself.

The present invention has been made to solve the above-described problems, and the object thereof is to provide a finned heat exchanger which is superior in quantity production, large in the radiating surface of the fins and compact in size.

SUMMARY OF THE INVENTION

In order to achieve the above-described object, according to the present invention, there is provided a heat exchanger which comprises: a tube; and a fin plate attached to an outer surface of the tube; the fin plate including: a partial cylindrical portion forming a recess which is fitted on the outer surface of the tube; flat fins projecting from both sides of the partial cylindrical portion; and upstanding fin means which is formed by cutting and erecting a part of the partial cylindrical portion and which extends in a direction away from the tube.

According to another aspect of the present invention, there is provided a heat exchanger which comprises: a tube through which a first fluid flows; and a fin plate attached to an outer surface of the tube; the fin plate comprising first and second fin plate elements fitted to one side of the tube and to an opposite side of the tube with the tube being held therebetween; each of the first and second fin plate elements comprising a partial cylindrical portion which forms a recess fitted on an outer surface of the tube; flat fins extending from both sides of the partial cylindrical portion; and an upstanding fin means which is formed by cutting and erecting a part of the partial cylindrical portion and which extends away from the tube.

According to a further aspect of the present invention, there is provided a heat exchanger comprising a tube unit having a tube including a plurality of parallel tube portions and extending along an imaginary plane; a corrugated plate member on which partial cylindrical portions are formed at intervals and in parallel, the partial cylindrical portions each forming a recess for receiving one side portion of each of the tube portions; and a fin plate element attached to an opposite side portion of each of the tube portions; the fin plate element including: a partial cylindrical portion which forms a recess fitted on the opposite side portion of each of the tube portions; flat fins extending from both sides of the partial cylindrical portion; and upstanding fin means which is formed by cutting and erecting a part of the partial cylindrical portion and which extends away from the tube.

DESCRIPTION OF THE PREFERRED EMBODIMENTS

Embodiments of the finned heat exchanger according to the present invention will be described with reference to the drawings.

Figure 1:
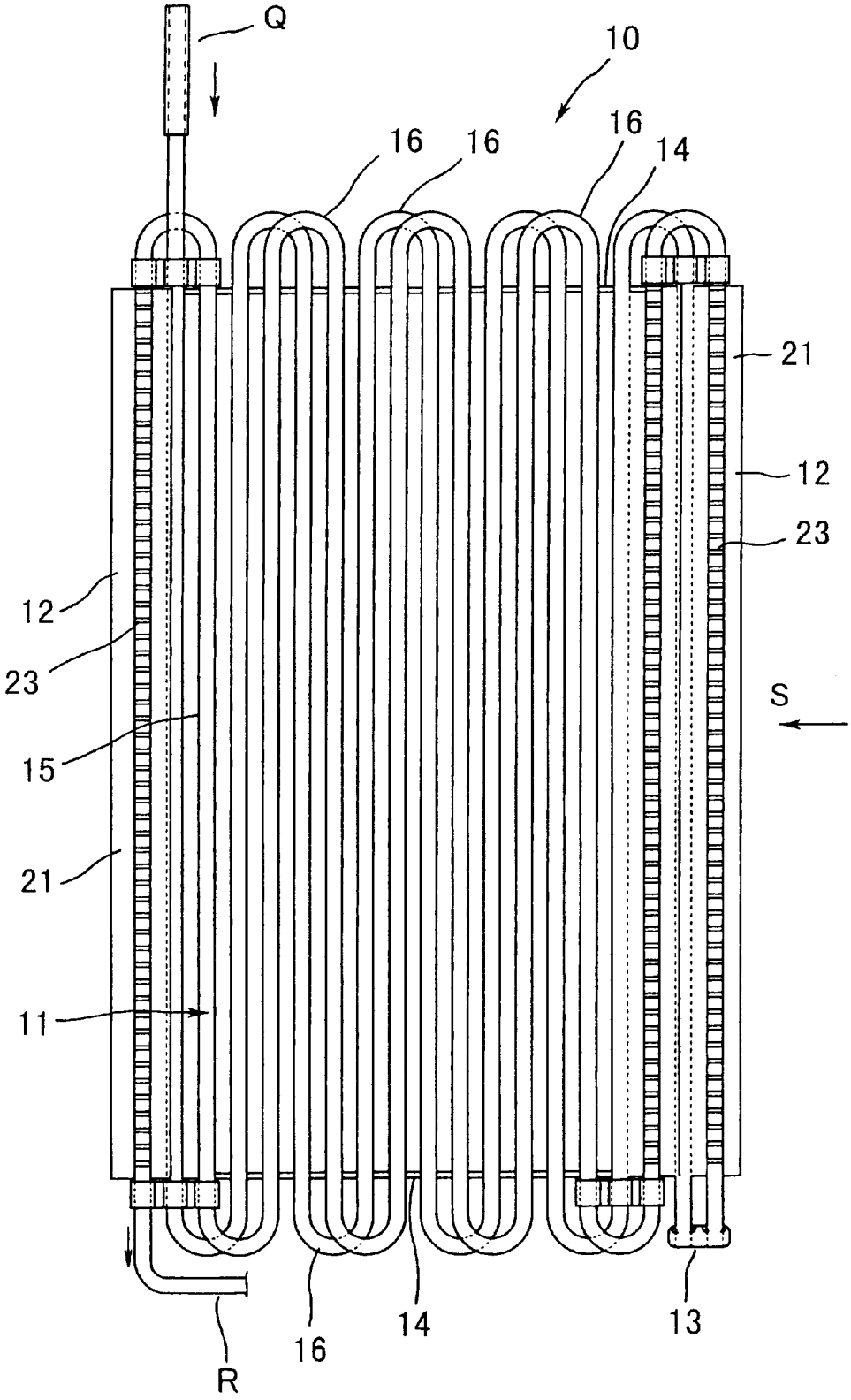
FIG. 1 is a plan view showing an embodiment of a heat exchanger according to the present invention.
Figure 2:
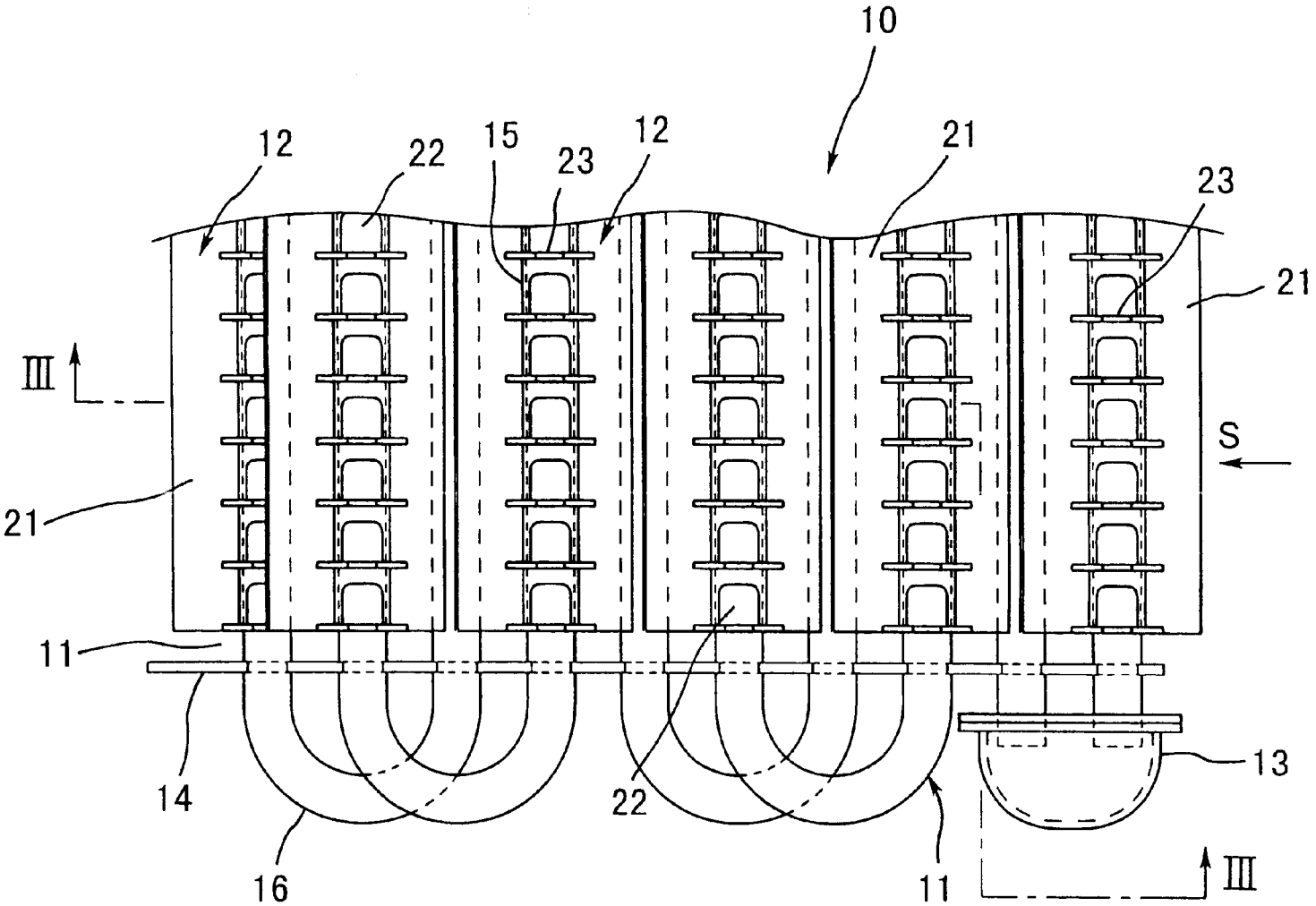
FIG. 2 is a view, on an enlarged scale, of a portion of the heat exchanger shown in FIG. 1.

FIG. 1 is a plan view showing a whole heat exchanger 10 for a refrigerator and FIG. 2 shows a portion of FIG. 1 on an enlarged scale. The heat exchanger 10 comprises tubes 11 and fin plates 12 applied to the outer surfaces of the tubes 11. A refrigerant as a first fluid is fed from a tube inlet Q into the interior of the tubes 11 to a tube outlet R by a compressor (not shown) and, simultaneously, air as a second fluid is caused to flow across the tubes 11 in the direction shown with the arrow mark S in FIGS. 1 and 2 to perform heat exchange with the refrigerant within the tubes 11 by way of the fin member 12.

Figure 3:
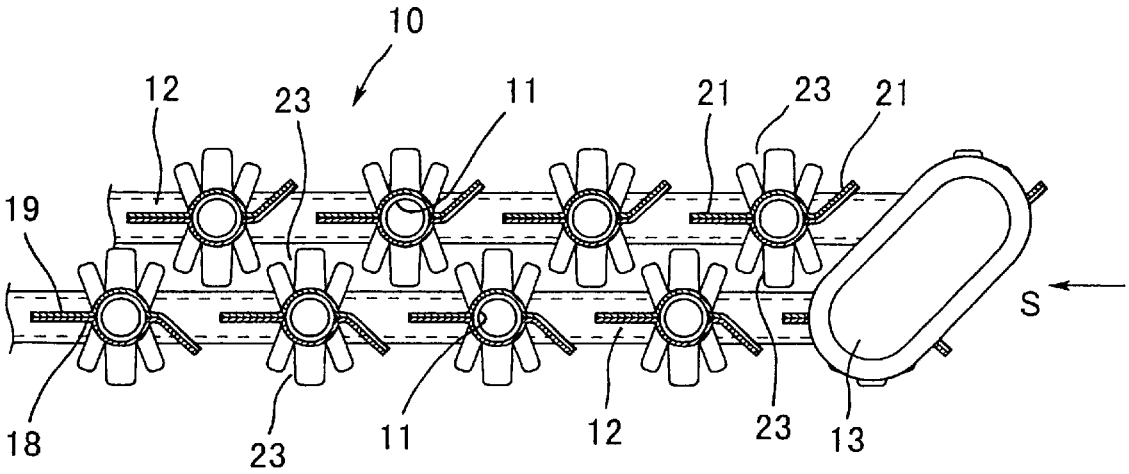
FIG. 3 is an elevational view partly in section taken along line III—III in FIG. 2.
Figure 4:
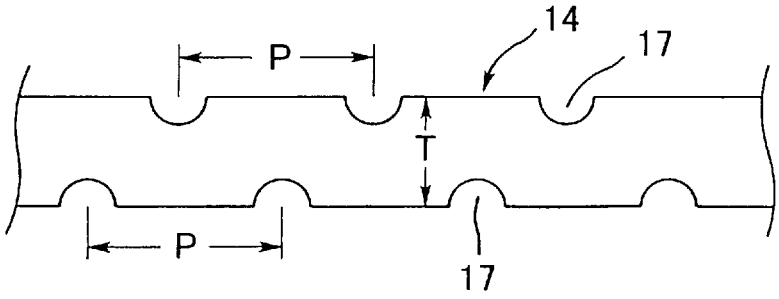
FIG. 4 is an enlarged view of a connecting plate.

As shown best in FIG. 3, the tubes 11 are composed of a plurality of, for example, two parallel planar tube units made of a steel, for example, each of the units being formed in such a manner that the ends of parallel straight tube portions 15 are connected by way of curved tube portions 16 in a zigzag or serpentine line as most clearly shown in FIG. 2. To each of the straight tube portions 15 of each tube unit is secured the fin plate 12. The two tube units are fixedly held at a distance in parallel by means of connecting plates 14 interposed between the tube units. Each connecting plate 14 is shaped as shown in FIG. 4 so that recesses 17 formed on the opposite longitudinal edges thereof, into which the straight portion 15 of the tubes 11 are fitted, are offset relative to each other by ½ pitch along the longitudinal edges thereof. Each connecting plate 14 is made of steel and functions as an air guide plate. The ends of the tubes 11 of the two tube units are connected by means of a connector 13 (FIG. 2 and FIG. 3) so as to communicate with each other. The connector 13 will be referred to later.

Figure 6:
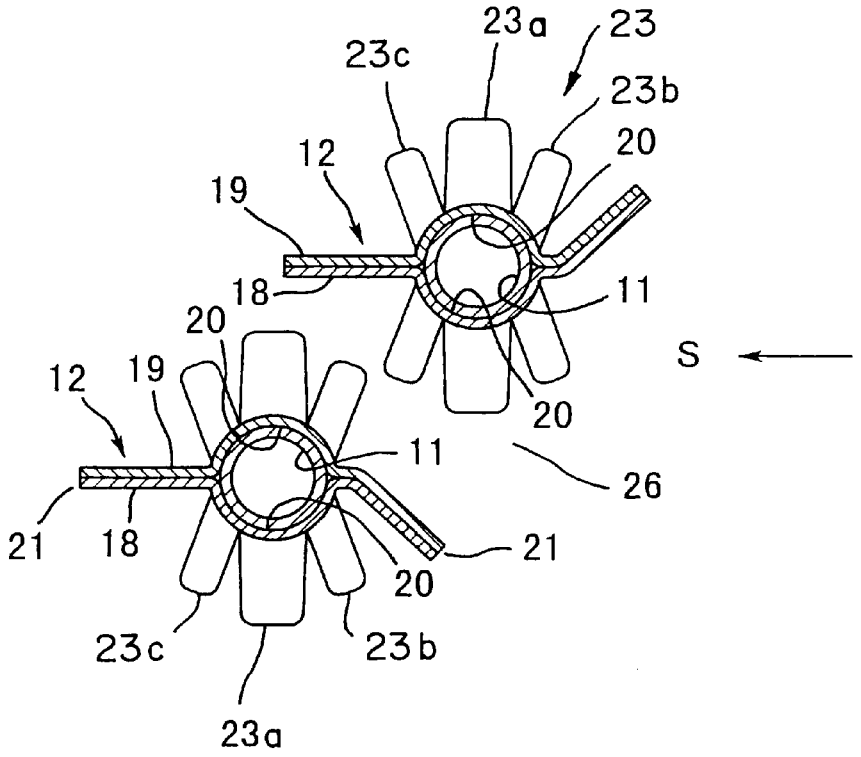
FIG. 6 is an enlarged front view, partly in section, of the portions of the erected fins.
Figure 7:
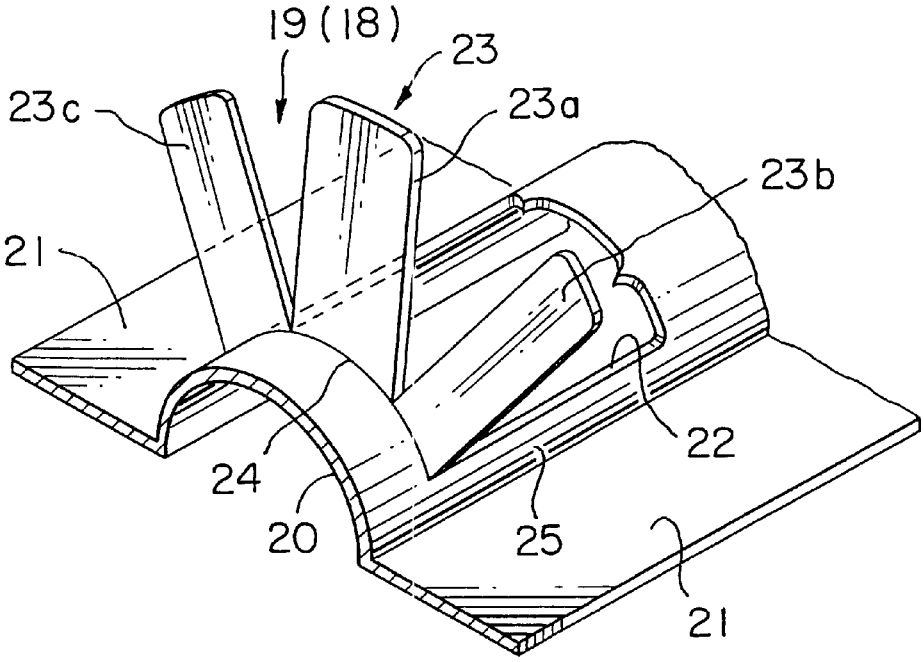
FIG. 7 is a perspective view showing a state after upstanding fins have been formed.
Figure 8:
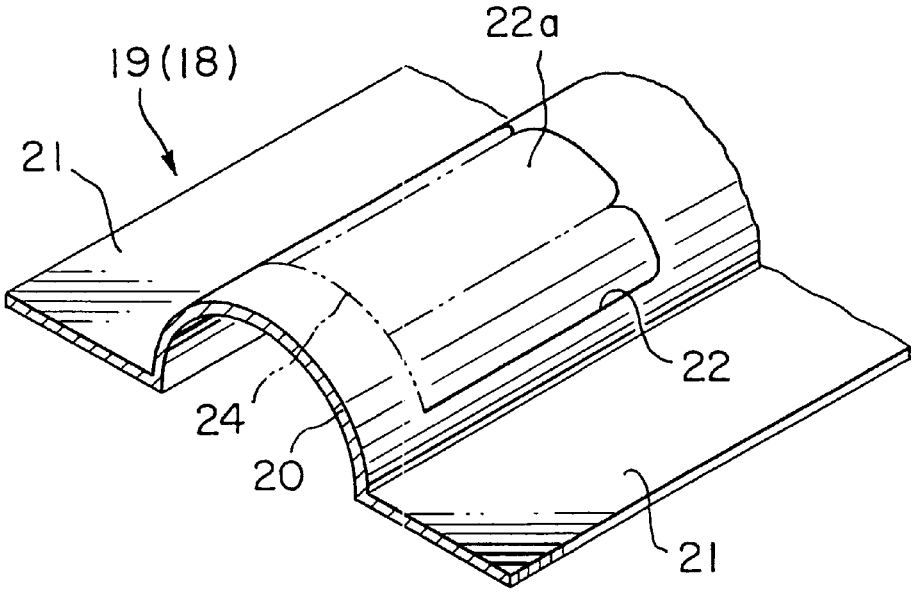
FIG. 8 is a perspective view showing a state before the upstanding fins are formed.

As shown in FIG. 6, each fin plate 12 is composed of a first fin plate element 18 and a second fin plate element 19 which are opposed to each other. The first fin plate element 18 and the second fin plate element 19 are equivalent in construction and are made of, for example, an iron plate. Each of the fin plate elements 18 and 19 is in the form of a strip sheet which has a width greater than the diameter of the tube 11 and which has a length corresponding substantially to the length of the straight tube portion 15 of the tube 11. As shown in FIG. 7, each of the fin plate elements 18 and 19 is formed, in the middle of the width thereof, with a partial cylindrical portion extending in the longitudinal direction and provided with a semi cylindrical recess 20 corresponding to the outer cylindrical shape of the pipe 11. The semicylindrical recess 20 has along both side edges flat fins 21 each integrally extending to the lateral side. Both flat fins 21 lie in the same plane in this embodiment. As shown in FIG. 8, on the semicylindrical portion which forms the semicylindrical recess 20 are formed a series of cut-pieces 22*a* each delimited by a U-shaped cut 22, at a pitch of 7 mm, for example, in the longitudinal direction. The cut-piece 22*a* are then erected substantially in the radially outward direction of the semi cylindrical recess 20 to thereby form an upstanding fin 23, as shown in FIG. 7.

Figure 9:
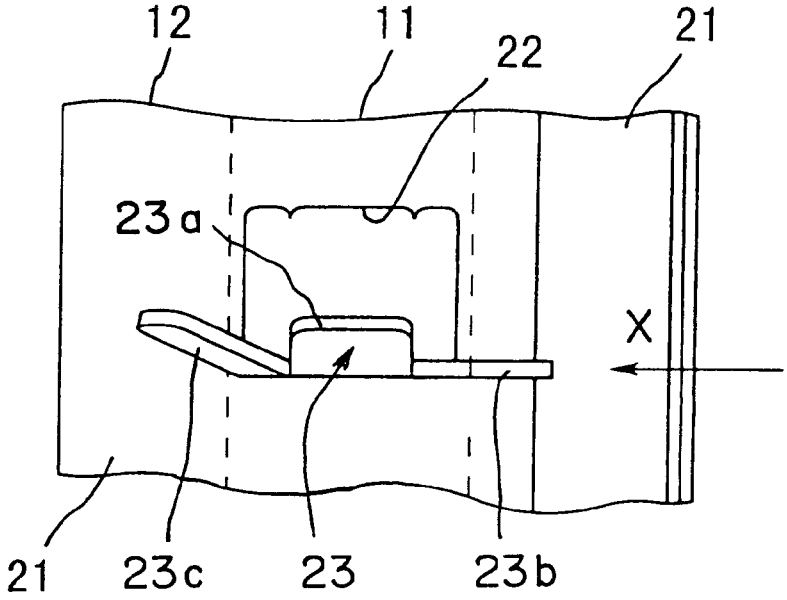
FIG. 9 is a plan view showing how the upstanding fins are erected.
Figure 10:
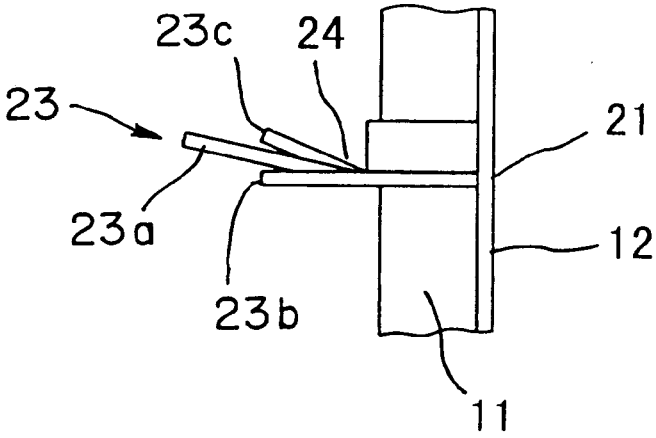
FIG. 10 is a side view as viewed along the arrow mark X in FIG. 9.

The base 24 of the upstanding fin 23 forms a portion of a circle which corresponds to the outer diameter of the tube 11, so that the upstanding fin 23 has to be divided in correspondence with this circle (into three segments in this embodiment). The three divided segments of the upstanding fin are indicated by 23*a*, 23*b* and 23*c*. As shown in FIGS. 9 and 10, these upstanding fins 23 are preferably provided in such a way as to make different the angles, at which the three divided upstanding fins 23*a*, 23*b* and 23*c* extend with respect to the outer surface of the tube 11, in order to enable good contact with the air flow to thereby improve the heat exchange of the heat exchanger 10. As indicated in FIG. 7, in that portion of the partial cylindrical portion adjacent to each flat fin 21, which makes contact with the tube 11, a curved surface portion 25 is left which is curved along the surface of the tube 11. This provides an increased contact area between the fin plate elements 18 and 19 and the tube 11.

Incidentally, the forming of these upstanding fins 23*a*, 23*b* and 23*c*, the curved portions 25 and so on are automatically carried out through a stamping work, and the processes such as punching, cutting, erecting, bending and so on are performed in one process.

The semicylindrical recess 20 of the first fin plate element 18 formed as described above is fitted on the outer surface of each straight tube portion 15 of the tube 11, and the semicylindrical recess 20 of the second fin plate element 19, which is identical to that of the first fin plate element 18, is fitted on the straight tube portion 15 on the side opposite the first fin plate element 18, whereby the tube 11 is held between the first fin plate element 18 and the second fin plate element 19. Subsequently, either opposite portions of the two overlapped flat fins 21 are spot-welded (or joined by plastic deformation) or each semicylindrical recess 20 and straight tube portion 15 are directly spot-welded, so that the tube 11 and the fin plate element 12 are fixedly secured. As shown in FIG. 1, on the air inflow sides of the flat fins 21, an inlet area 26 may be formed in such a way that the flat fins 21 of the two tube units are bent away from each other so that the two flat fins 21 open toward the inflow direction of air. It will be noted that in this case, the flat fins 21 at both sides do not lie in the same plane.

The connector 13 is a member which connects the ends of the tubes 11 of the two planar tube units, in an oblique direction, as shown in FIG. 3, and is formed by stamping a steel material so that it has a smoothly curved surface which makes pressure loss as small as possible. Adjustment in the width and thickness of the entire heat exchanger 10 composed of the two tube units can be made by changing the pitch P of the recesses 17 and width T (FIG. 4) of the connecting plate 14. Incidentally, the connector 13 may be replaced by a connecting tube in the form of a U bend.

The heat exchanger 10 as configured above facilitates attachment of the fin plate elements 18, 19 to the straight tube portions 15 and is superior in quantity production. Furthermore, the heat exchanger 10 realizes fine pitch of the fins and increased radiating area (increased by approximately 1.5 times over that of the conventional finned heat exchanger of the same specification). Therefore, the heat exchanger according to the present invention is smaller in size than that of the prior art.

In the present embodiment, the tubes 11 and fin plates 12 made of an iron material are used; however, ones made of copper, aluminum or similar materials having a good heat transfer property may be used. Further, for heat exchange, air is used for the second fluid in the present embodiment, however, liquid such as water or other fluids may be used.

As described above, the embodiment of the present invention enables an increase of the number of the fins and, accordingly, the radiating area is increased, whereby a heat exchanger which is excellent in heat exchange is provided. Moreover, since increasing the number of the upstanding fins allows the heat exchanger to be made small in size and compact, this heat exchanger can be installed at a place, for example, below a bottom plate or the like of a refrigerator where there is no influence of the generation of heat. Further, since, the flat fins and the upstanding fins can be formed on the fin plate elements in one process of forming work, a heat exchanger which is superior in productivity, easy to assemble, superior in quantity production and low in cost can be provided.

Moreover, connection of the ends of the tubes through a connector provides a compact heat exchanger which enables adjustment in the thickness of the heat exchanger. Further, in the case where the inlet area is formed in the fluid inflow direction of the flat fins, and where the erection angles of the upstanding fins are made different, there is provided an advantageous effect of the performance of heat exchange being increased, together with an advantageous effect in that the provision of the heat exchanger as a single unit facilitates removal of the heat exchanger for recycling.

Figure 11:
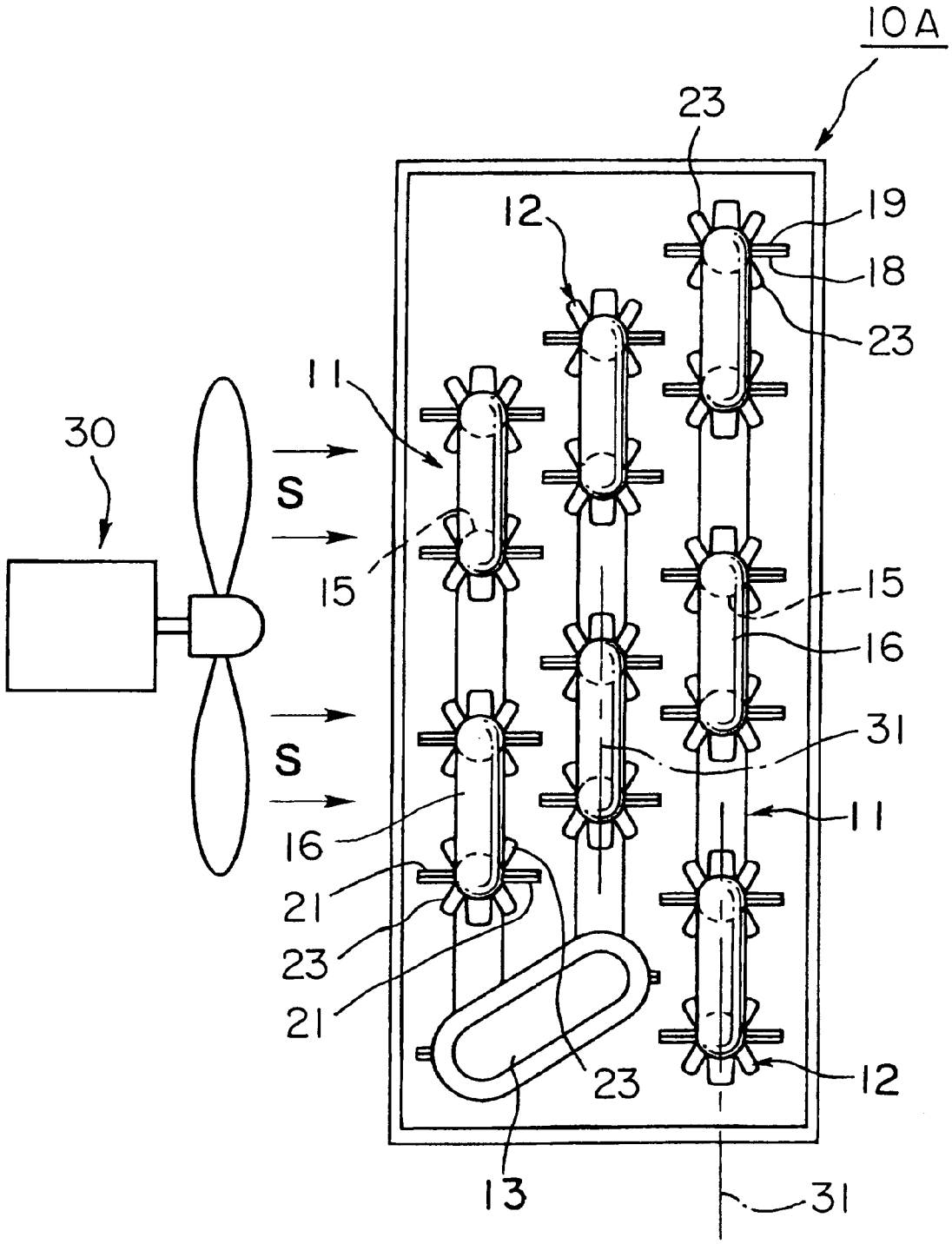
FIG. 11 is a side view of another embodiment of the heat exchanger according to the present invention.
Figure 12:
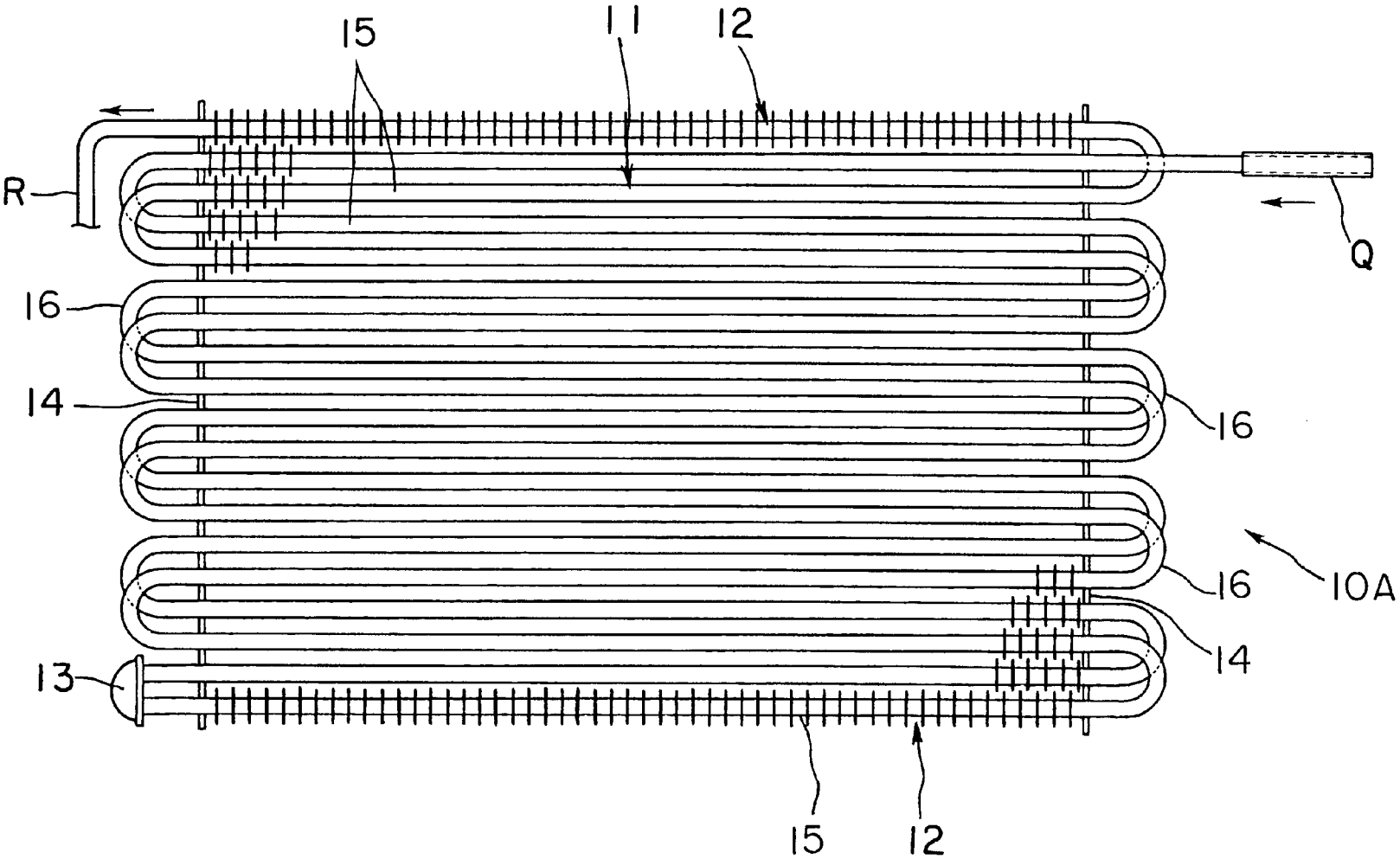
FIG. 12 is a side view showing the embodiment of the heat exchanger shown in FIG. 11.
Figure 13:
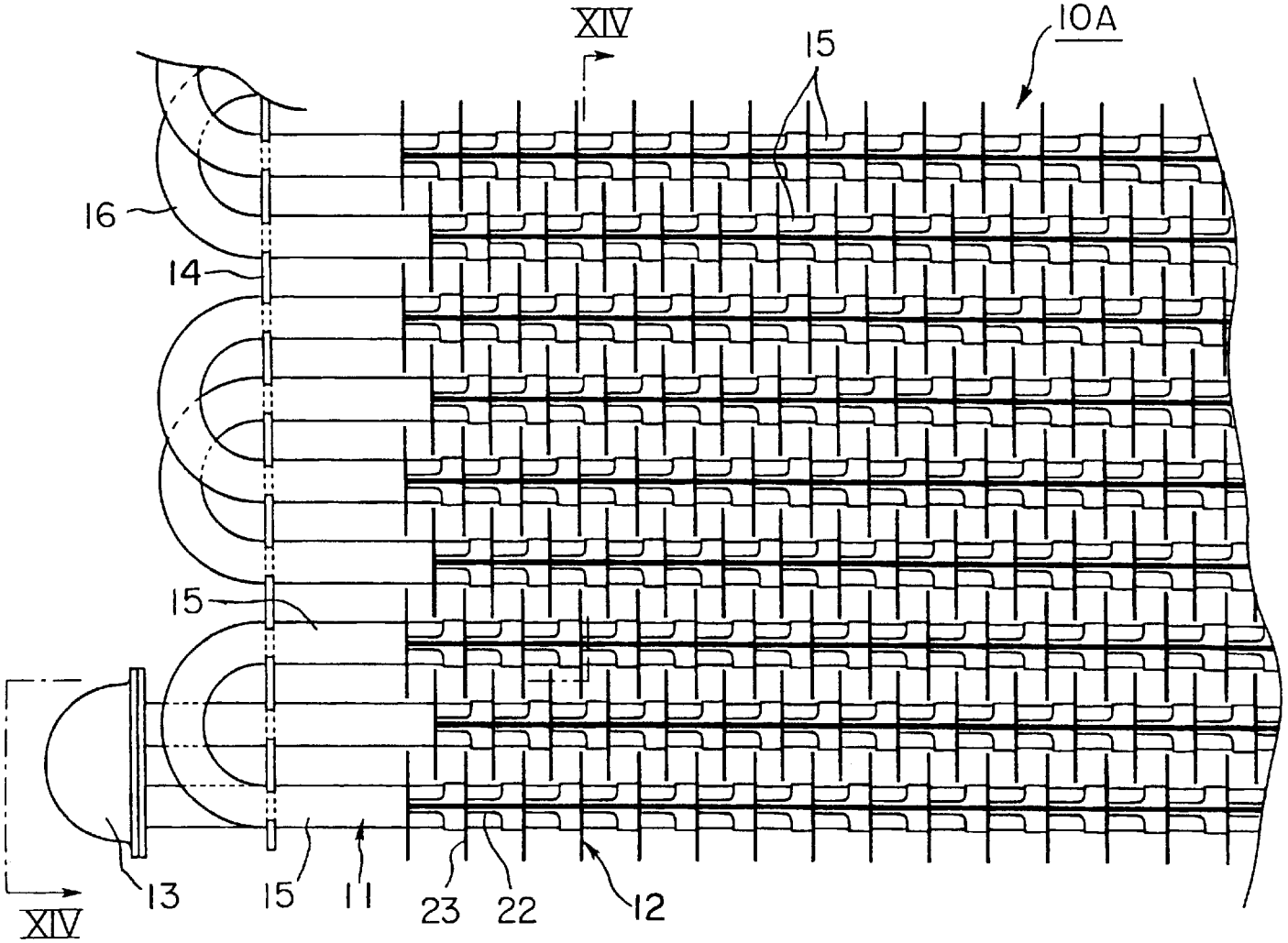
FIG. 13 is an enlarged view of a portion of FIG. 12.

FIGS. 11 to 14 show a further embodiment of the heat exchanger according to the present invention. As shown in FIGS. 11 and 12, the heat exchanger 10A comprises tubes 11, fin plates 12, a connector 13 and connecting plates 14, similar to those in the embodiment described before, and it includes a blower 30 as a fluid feeding means shown in FIG. 11. Refrigerant as a first fluid is fed from the tube inlet Q into the interior of the tubes 11 to the tube outlet R by means of a compressor (not shown) and, simultaneously, air as a second fluid is caused to flow in the direction shown with the arrow mark S in FIGS. 11 and 14 (in FIG. 12, perpendicular to the surface of the sheet in a direction from the back of the sheet to the front) by means of the blower 30, and heat exchange is carried out with the refrigerant within the tubes 11 by way of the fin plates 12.

In this embodiment, the tubes 11 are composed of, for example, three tube units, each unit being constituted by a serpentine tube 11 which comprises straight tube portions 15 arranged in parallel and curved tube portions 16 by way of which the straight tube portions 15 are connected. Each serpentine tube 11 is formed to be planar as a whole and has an imaginary plane 31 (FIG. 11). This imaginary plane 31 lies in an up-and-down direction with respect to the horizontal plane, for example, in the vertical direction. Moreover, the straight tube portions 15 of the tube 11 extend in the horizontal direction, and the fin plates 12 are secured to the outer surface of the straight tube portions 15. Further, each of the three tube profile units are connected at a distance from each other through the connecting plates 14 extending in the vertical direction in a manner similar to those shown in FIG. 4, with their imaginary plans 31 being maintained in parallel with each other.

Figure 5:
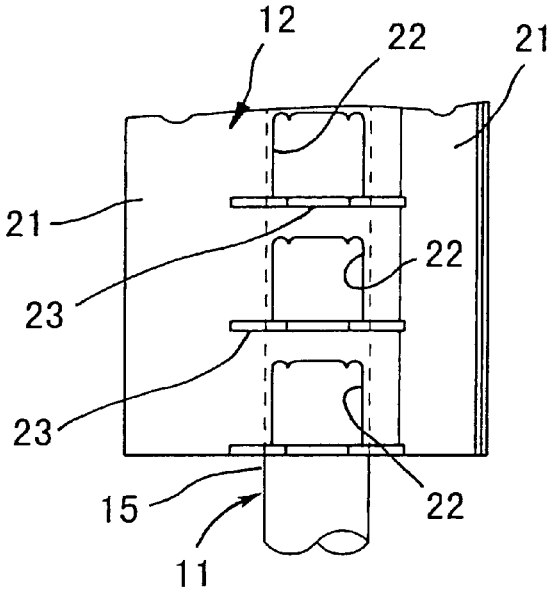
FIG. 5 is an enlarged plan view showing erected fins.

Each of the fin plates 12 is formed fundamentally similar to those already described with reference to FIGS. 5 and 7. Namely, the first fin plate element 18 and the second fin plate element 19 are secured to the straight tube portion 15 in such a way that the first and second fin plate elements 18 and 19 are fitted on the straight tube portion 15 from both sides thereof diametrically opposite one another. Further, the upstanding fins 23 are formed by cutting the partial cylindrical portions of the fin plate elements 18 and 19 and erecting the cut pieces in the same manner as shown in FIGS. 7 and 8. However, in this embodiment, the flat fins 21 at both sides of the opposite fin elements 18 and 19 extend in parallel in the direction of the letter S which is the air inflow direction, as shown in FIG. 14, unlike the structure shown in FIG. 6.

Figure 14:
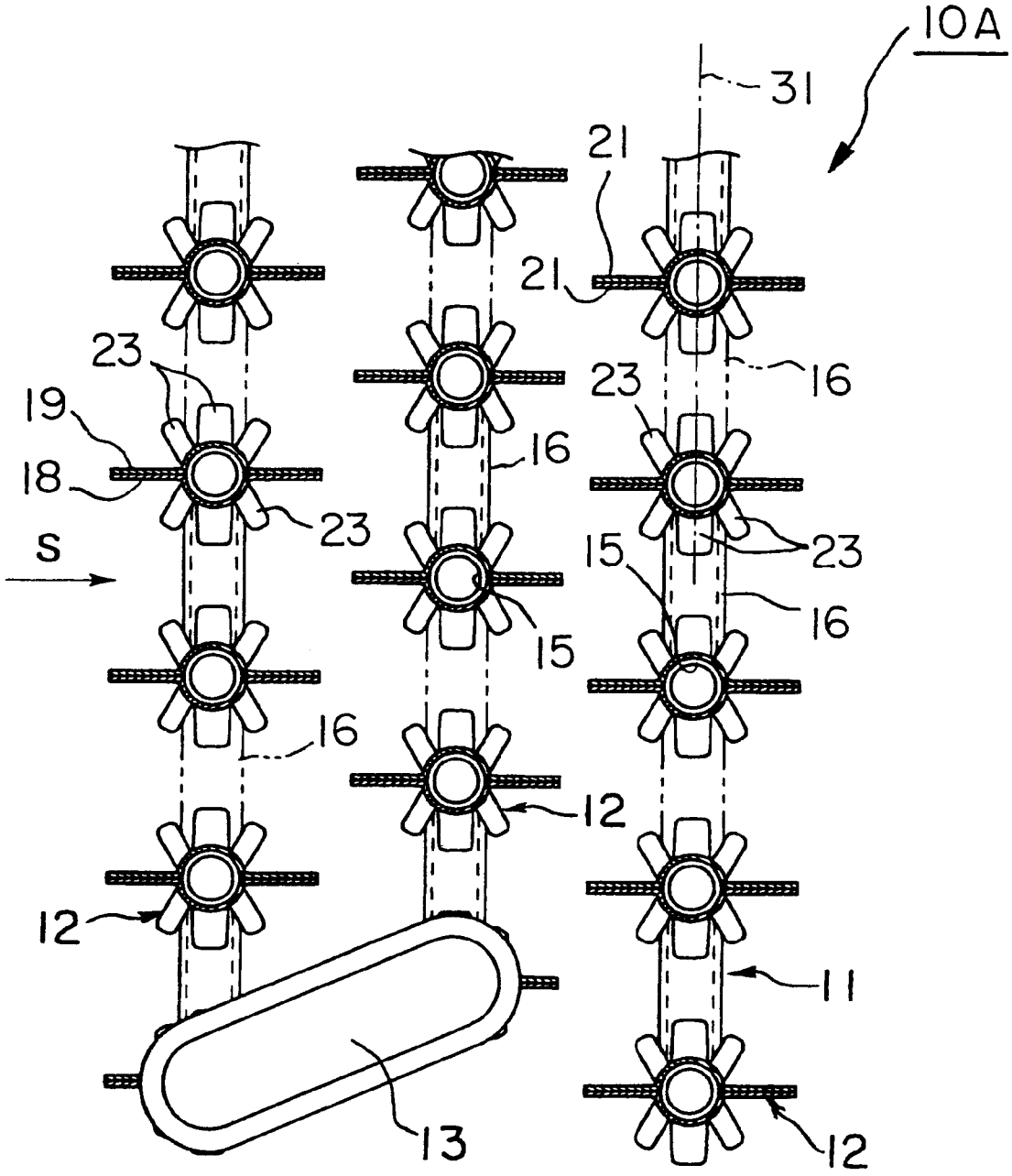
FIG. 14 is a side view taken along line XIV—XIV in FIG. 13.

As shown in FIG. 14, the fitting of the fin plates 12 onto the straight tube portions 15 is performed in such a way that the flat fins 21 of each fin plate 12 are directed horizontal and, moreover, make a predetermined angle (approximately 90 degrees in FIG. 14) with respect to the imaginary planes formed by the tube units.

Incidentally, the air inflow side of the flat fins 21 may be formed in such a way that, similar to the case shown in FIG. 6, the flat fins 21 of adjoining fin plates 12 extend away from each other toward the air inflow side and are bent to open towards each other.

Figure 15:
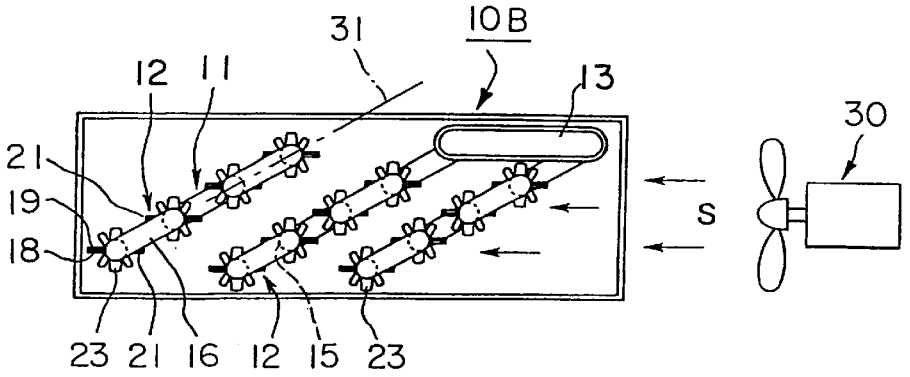
FIG. 15 is a side view showing a modification of the embodiment of FIG. 11.

In the embodiment shown in FIG. 15, the imaginary planes 31 of the tube units are inclined with respect to the horizontal plane as an example of having a component of the up-and-down direction. The three tube units are made parallel to each other. Thus the heat exchanger 10B can have a reduced height. In this case, air is fed in the direction indicated by the arrow mark S in FIG. 15 and, thus, air is fed obliquely with respect to the imaginary planes 31 and in a direction parallel to the surfaces of the flat fins 21 and the upstanding fins 23.

The heat exchangers 10A and 10B constituted as described above make it easy for the fin plate elements 18 and 19 to be fitted onto the straight tube portions 15, and are good in quantity production. Further, since the pitch of the fins can be made fine and the radiation area can be made large, a heat exchanger which is small in size can be provided.

In the present embodiment, the tubes 11 and the fin plates 12 are made of steel material; however, they may be made of a material such as copper, aluminum or the like which is superior in heat transfer. Further, air is used for the heat exchange; however, liquid such as water and so on may be used.

In the embodiment shown in FIGS. 11 to 15, the imaginary plane of the serpentine tube of each tube unit is in the up-and-down direction with respect to the horizontal plane, and the second fluid flows in the direction which makes an angle with the imaginary plane and along the surfaces of the flat fins and upstanding fins; accordingly, there is no large resistance against the second fluid so that a compressor or the like in a machinery room can be cooled.

The inclination of the imaginary plane with respect to the feeding direction of the second fluid enables the heat exchanger to have a reduced height. Moreover, the provision of the heat exchanger as a single unit facilitates removal of the heat exchanger for recycling.

Figure 16:
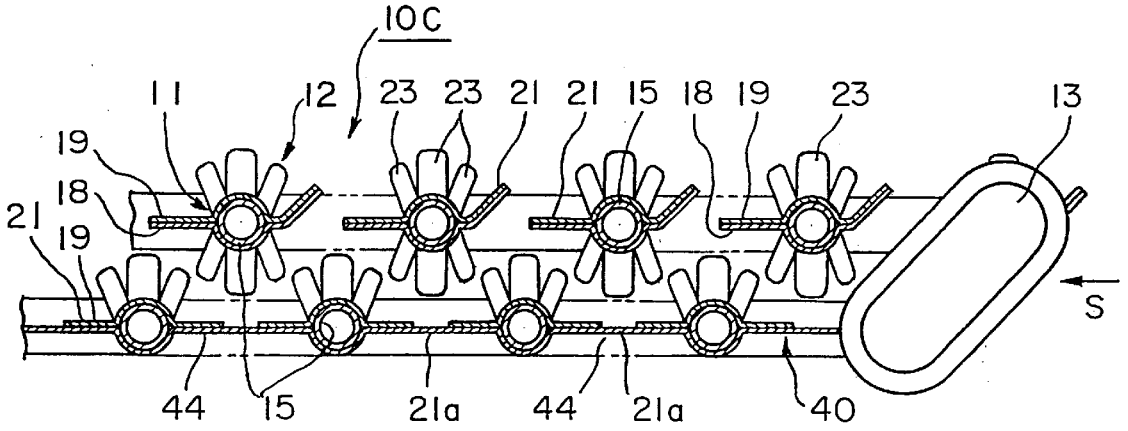
FIG. 16 is an elevational view, partly in section, of a further embodiment of the heat exchanger according to the present invention.
Figure 17:
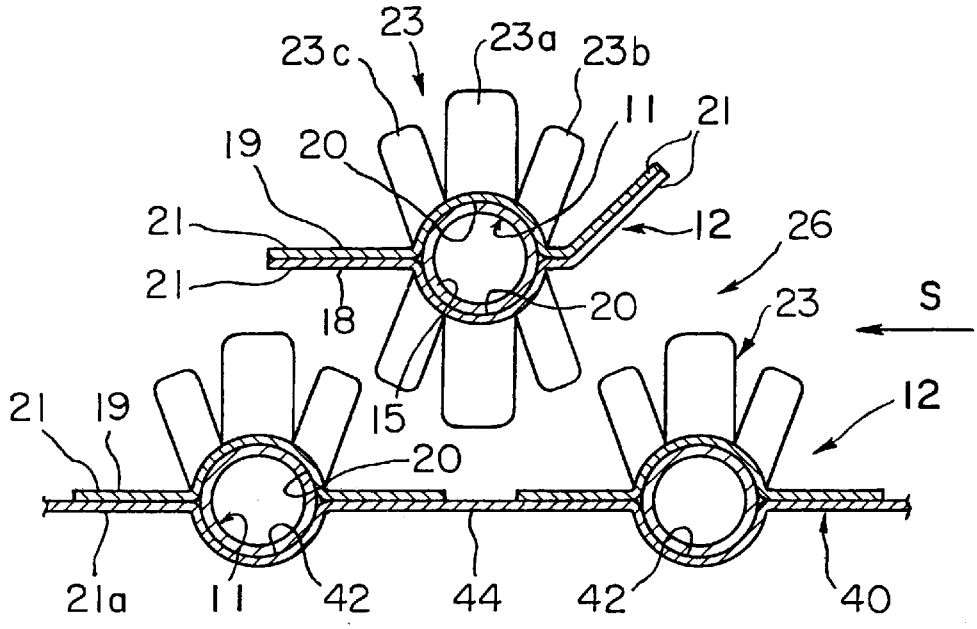
FIG. 17 is an enlarged view of a portion of FIG. 16.
Figure 18:
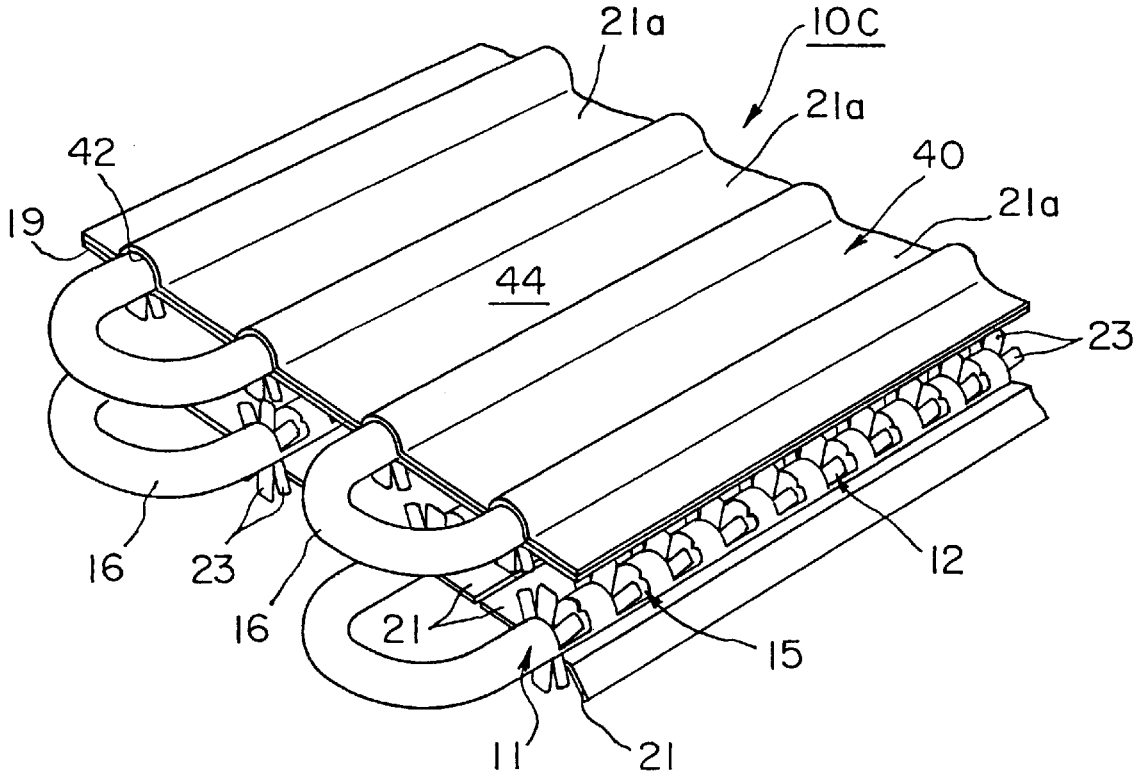
FIG. 18 is a bottom view of the heat exchanger shown in FIG. 16.

FIGS. 16 to 18 show a heat exchanger 10C according to a further embodiment. This heat exchanger 10C is similar to the embodiment shown in FIG. 3, however, one of the tube units of the heat exchanger (the tube unit at the lower side in FIG. 16) is different in structure from the heat exchanger in FIG. 3.

As shown in FIG. 16, the tube 11 is constituted, for example, by an upper row and a lower row, i.e., an inner and an outer unit, and each unit is formed in such a way that the straight tube portions 15 are made horizontal and in parallel, and are connected by way of the curved tube portions 16 (not shown) so that they extend in a serpentine path included in a plane. Further, to the straight tube portions 15 of the tube 11 are secured fin plates 12 and/or corrugated plate member 40 which will be described later. The straight tube portions 15 of each tube unit are connected at intervals and in parallel by fitting the connecting plate 14, which is similar to that shown in FIG. 4, onto both end portions of the straight tube portions. Moreover, the two tube units are connected at their ends by way of a connector 13 to thereby allow them to communicate with each other.

Each of the fin plates 12 of the tube unit shown at the upper side in FIGS. 16 and 17 is formed in such a way that the semicylindrical recess 20 of the first fin plate element 18 is fitted onto the straight tube portion 15 of the tube 11, and the semicylindrical recess 20 of the second fin plate element 19 which is identical to the first fin plate element is put onto the straight tube portion 15 from the side opposite the first fin plate element 18, to thereby hold the straight tube portion 15 between the first fin plate element 18 and the second fin plate element 19. Subsequently, the straight tube portion 15 and the fin plates elements 18 and 19 are secured either by spot-welding (or plastic deformation) the two overlapped portions of the flat fins 21 or by spot-welding directly each semicylindrical recess 20 and the straight tube portion. On the upper side and at the air inflow side of the flat fin 21 is formed an inlet area 26, into which air is guided since the flat fins 21 are bent obliquely upwards so as to open toward the air inflow side.

As shown in FIGS. 16 to 18, the corrugated plate member 40 is used, for example, as a floor surface side of a refrigerator, i.e., as a fin plate element facing the outside, which is made of, for example, iron plate, and is in the form of a rectangular plate having a size corresponding to the overall size of the straight tube portion 15 of the tube unit at the lower side of the heat exchanger 10C. On the surface of the corrugated plate member 40 at the positions corresponding to the straight tube portions 15 of the tube 11 are formed semicylindrical concave grooves 42 (FIG. 17) in parallel and in the form corresponding to the cylindrical shape of the straight tube portions 15 of the tube 11. From both sides of each semicylindrical concave groove 42 extend flat fins 21*a* towards adjacent semicylindrical concave grooves 42. Into the semicylindrical concave grooves 42 of the corrugated plate member 40 formed in this way are fitted the straight tube portions 15 of the tube 11 at the lower side, i,e, the outer tube unit. Furthermore, onto the straight tube portions 15 are fitted the semicylindrical concave grooves 20 of the second fin plate elements 19 from the side opposite the corrugated plate member 40, i.e., from the upper side (inner side), to thereby hold the straight tube portions 15 of the tube 11 between the corrugated plate member 40 and the second fin plate element 19. Subsequently, the tube 11, the fin plate element 19, and the corrugated plate member 40 are secured together either by spot welding (or plastic deformation) the two overlapped portions of the flat fins 21 and 21*a,* or by directly spot-welding the semicylindrical concave grooves 42 of the corrugated plate member 40 and the straight tube portions 15, and the semicylindrical concave grooves 20 of the second fin plate elements 19 and the straight tube portions 15.

Since the heat exchanger 10C is deformed as described above, the assembly of the first fin plate element 18 with the second fin plate element 19, and of the corrugated plate member 40 with second fin plate element 19, is easy and the heat exchanger 10C is good in quantity production; furthermore, an increased number of fins can be provided and their radiation area can be increased, whereby the heat exchanger 10C can be made small in size. Moreover, since the corrugated plate member 40 can serve also as a floor cover 44 (FIG. 18), the construction of the bottom of a refrigerator can be made simple and, simultaneously, the corrugated plate member 40 can serve also as a duct through which air flows toward the fins.

In the present embodiment, the tube 11 and the fin plates 12 are made of steel material; however, they may be made of a material such as copper, aluminum and so on which is superior in heat transfer. Further, in this embodiment the heat exchange is performed by air; however, liquid such as water or the like can be used. Moreover, the corrugated plate member 40 is made using a flat plate; however, in place thereof, it can be formed by a plate material (plate material similar to the second fin plates 19) in the form of a strip corresponding to each straight tube portion 15 of the tube 11, and adjacent strip-like plates may be welded along the longitudinal edges thereof. If required, a gap can be provided between adjacent strip-like plates.

Although the heat exchanger in the above-described embodiment is described as one provided on the bottom of a refrigerator, the heat exchanger according to this embodiment can be installed also on the back surface of the refrigerator. In this case, the side facing the back is treated as the outside and the side facing the refrigerator is treated as the inside. Further, the semicylindrical concave grooves of the corrugated plate member 40 and the semicylindrical recess of the second fin plate element opposite the semicylindrical concave grooves can be changed in the ratio of the angles from the center of the tube to said semicylindrical concave groove and to the semicylindrical recess which cover the straight tube portion of the tube. For example, if the center angle of the semicylindrical recess of the second fin plate element is enlarged until it covers the major part of the outer periphery of the straight tube portion, the center angle of the semicylindrical concave groove of the corrugated plate member becomes small and, under an extreme condition, the corrugated plate member becomes a mere flat plate. The present invention also includes such a case.

In this embodiment, increasing the number of the upstanding fins allows the heat exchanger to be made small in size and compact; therefore, this heat exchanger can be installed as a single unit at a place where there is no influence of the generation of heat, for example, a place below the floor wall or rear the back wall of a refrigerator. Further, while the tube is held between the fin plate elements, the flat fins and the upstanding fins can be formed on said fin plates in one process of forming work and, accordingly, the heat exchanger is superior in productivity, easy to assemble, superior in quantity production, thereby enabling production of a low-cost heat exchanger.

Moreover, since the corrugated plate member also serves as a cover plate, the construction of the bottom and back of a refrigerator become simple and inexpensive. The corrugated plate member, also serves as a duct along which air flows to the fins, thereby improving the performance of heat exchange. Furthermore, the installation of the heat exchanger as a single unit facilitates its removal for recycling.

What is claimed is:

1. A heat exchanger comprising:

a tube; and a fin plate attached to an outer surface of said tube;

said fin plate including:

a partial cylindrical portion forming a recess which is fitted on the outer surface of said tube;

flat fins extending from both sides of said partial cylindrical portion; and upstanding fin means erected from said Partial cylindrical portion in a direction away from said tube in such a manner that the partial cylindrical portion has formed therein a cutout which is equal in size to the upstanding fin means.

2. A heat exchanger as claimed in claim 1, wherein said upstanding fin means comprises a plurality of upstanding fins.

3. A heat exchanger as claimed in claim 2, wherein said upstanding fins have different erecting angles.

4. A heat exchanger as claimed in claim 1, wherein the partial cylindrical portion forming said recess is a semi cylindrical portion.

5. A heat exchanger as claimed in claim 1, wherein the flat fins extending from both sides of said partial cylindrical portion lie in a plane.

6. A heat exchanger as claimed in claim 1, wherein the flat fins extending from both sides of said partial cylindrical portion lies in different planes.

7. A heat exchanger comprising:

a tube through which a first fluid flows; and a fin plate attached to an outer surface of said tube;

said fin plate comprising first and second fin plate elements fitted to one side of said tube and to an opposite side of said tube with the tube being held therebetween;

each of said first and second fin plate elements comprising:

a partial cylindrical portion which forms a recess fitted on an outer surface of said tube;

flat fins extending from both sides of said partial cylindrical portion; and upstanding fin means erected from said partial cylindrical portion in a direction away from said tube in such a manner that the Partial cylindrical portion has formed therein a cutout which is equal in size to the upstanding fin means.

8. A heat exchanger as claimed in claim 7, wherein said tube is provided with a plurality of straight tube portions, and said fin plate is attached to each of said straight tube portions.

9. A heat exchanger as claimed in claim 7, wherein the flat fins of said first and second fin plate elements are joined with each other in a surface-to-surface contact.

10. A heat exchanger as claimed in claim 7, wherein said tube comprises:

a first tube unit disposed along a first imaginary plane; and a second tube unit disposed along a second imaginary plane which extends in parallel to said first imaginary plane; and said heat exchanger further comprises:

connecting plates interposed between said first and second tube units to hold the tube units at a distance from each other; and a connector connecting the tubes of said first and second tube units in communication with each other.

11. A heat exchanger as claimed in claim 7, comprising:

a tube unit which includes said tube disposed along an imaginary plane; and at least some of said flat fins of said first and second fin plate elements lies in said imaginary plane.

12. A heat exchanger as claimed in claim 11, wherein some of said flat fins makes an angle with said imaginary plane.

13. A heat exchanger as claimed in claim 7, comprising:

a tube unit which includes said tube disposed along an imaginary plane; and said flat fins of said first and second fin plate elements extend in a direction of making an angle with said imaginary plane.

14. A heat exchanger as claimed in claim 13, wherein said angle is a right angle.

15. A heat exchanger as claimed in claim 13, wherein said angle is an angle other than a right angle.

16. A heat exchanger as claimed in claim 13, further comprising a fluid feeding means for causing a second fluid to flow across said tube unit in a direction along said flat fins.

17. A heat exchanger comprising:

a tube unit having a tube including a plurality of parallel tube portions and extending along an imaginary plane;

a corrugated plate member on which partial cylindrical portions are formed at intervals and in parallel, said partial cylindrical portions each forming a recess for receiving one side portion of each of said tube portions; and a fin plate element attached to an opposite side portion of each of said tube portions, said fin plate element including:

a partial cylindrical portion which forms a recess fitted on said opposite side portion of each of said tube portions;

flat fins extending from both sides of said partial cylindrical portion; and upstanding fin means which is formed by cutting and erecting a part of said partial cylindrical portion and which extends away from the tube.

18. A heat exchanger as claimed in claim 17, wherein said flat fins are in a direction along said corrugated plate member and joined to said corrugated plate member.

19. A heat exchanger, as claimed in claim 17, further comprising:

a second tube unit including a tube having a plurality of parallel tube portions and extending along a second imaginary plane which is parallel to said imaginary plane; and a fin plate attached to an outer surface of each of the tube portions of the second tube unit;

said fin plate including:

a partial cylindrical portion forming a recess fitted on the outer surface of each of said tube portions;

flat fins extending from both sides of said partial cylindrical portion; and upstanding fin means which is formed by cutting and erecting a part of said partial cylindrical portion and which extends away from said tube.

20. A heat exchanger as claimed in claim 1, wherein said upstanding fin means is bent from said partial cylindrical portion along an arc of a circle disposed in a plane extending transversely of said partial cylindrical portion.

21. A heat exchanger as claimed in claim 20, wherein said upstanding fin means comprises a plurality of upstanding fins in a side-by-side arrangement along said arc of said circle.

22. A heat exchanger as claimed in claim 21, wherein said plurality of upstanding fins extend at respectively different upstanding angles relative to said partial cylindrical portion.

23. A heat exchanger as claimed in claim 21, wherein said flat fins extend radially from said partial cylindrical portion and longitudinally along said partial cylindrical portion, said upstanding fins extending along said arc of said circle transversely around said partial cylindrical portion.

24. A heat exchanger as claimed in claim 1, wherein a plurality of said upstanding fin means are spaced longitudinally along said tube, each said upstanding fin means comprising a plurality of upstanding fins disposed transversely of said tube and extending circumferentially thereabout.

* * * * *